US008993498B2

(12) United States Patent
Manabe et al.

(10) Patent No.: US 8,993,498 B2
(45) Date of Patent: Mar. 31, 2015

(54) CONTINUOUSLY VARIABLE TRANSMISSION OIL COMPOSITION

(75) Inventors: Yoshitaka Manabe, Saitama (JP); Shin Saeki, Saitama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 111 days.

(21) Appl. No.: 13/148,348

(22) PCT Filed: Feb. 8, 2010

(86) PCT No.: PCT/JP2010/051743

§ 371 (c)(1),
(2), (4) Date: Aug. 8, 2011

(87) PCT Pub. No.: WO2010/092912

PCT Pub. Date: Aug. 19, 2010

(65) Prior Publication Data

US 2011/0306530 A1 Dec. 15, 2011

(30) Foreign Application Priority Data

Feb. 16, 2009 (JP) ..... 2009-032870

(51) Int. Cl.

*C10M 169/04* (2006.01)
*C10M 159/12* (2006.01)
*C10M 137/10* (2006.01)
*C10M 137/04* (2006.01)

(52) U.S. Cl.

CPC ..... *C10M 137/105* (2013.01); *C10M 137/04* (2013.01); *C10M 2203/1006* (2013.01); *C10M 2207/2825* (2013.01); *C10M 2215/28* (2013.01); *C10M 2219/044* (2013.01); *C10M 2219/046* (2013.01); *C10M 2219/083* (2013.01); *C10M 2223/041* (2013.01); *C10M 2223/043* (2013.01); *C10M 2223/047* (2013.01); *C10M 2223/049* (2013.01); *C10N 2220/022* (2013.01); *C10N 2230/06* (2013.01); *C10N 2230/52* (2013.01); *C10N 2240/045* (2013.01)

USPC ..... 508/329; 508/287; 508/423

(58) Field of Classification Search

CPC . C10M 137/02; C10M 104/04; C10M 137/10
USPC ..... 508/423, 329, 287
See application file for complete search history.

(56) References Cited

U.S. PATENT DOCUMENTS

| | | | | |
|---|---|---|---|---|
| 5,344,468 | A * | 9/1994 | Hanlon et al. | 44/379 |
| 5,403,501 | A | 4/1995 | Schwind | |
| 5,560,849 | A * | 10/1996 | Shankwalkar et al. | 508/423 |
| 5,792,731 | A | 8/1998 | Ichihashi et al. | |
| 2003/0013619 | A1 * | 1/2003 | Sato et al. | 508/192 |
| 2005/0082139 | A1 | 4/2005 | Ishikawa et al. | |
| 2005/0176593 | A1 * | 8/2005 | Ward et al. | 508/162 |
| 2007/0155632 | A1 * | 7/2007 | Hata et al. | 508/258 |
| 2009/0275491 | A1 | 11/2009 | Komatsubara et al. | |

FOREIGN PATENT DOCUMENTS

| | | |
|---|---|---|
| CN | 1056894 | 12/2011 |
| EP | 0 521 628 | 1/1993 |
| EP | 0 612 837 | 8/1994 |
| EP | 0 805 194 | 11/1997 |
| JP | 5-194559 | 8/1993 |
| JP | 3199844 | 8/1993 |
| JP | 8-176163 | 7/1996 |
| JP | 2000-109867 | 4/2000 |
| JP | 2000-109872 | 4/2000 |
| JP | 2000-109875 | 4/2000 |
| JP | 2000-336386 | 12/2000 |
| JP | 2000-355695 | 12/2000 |
| JP | 2005-69248 | 3/2005 |
| JP | 2005-97553 | 4/2005 |
| WO | 2007/052833 | 5/2007 |

OTHER PUBLICATIONS

Search Report issued with respect to patent family member European Patent Application No. 10741189.4, mailed Nov. 5, 2012.

Mabuchi et al., "Effect of CVTF additive, ZnDTP, on inprovement of transferred torque of belt CVT (First Report)", Japanese Society of Tribologists, proceedings of the Tribiology Conference, 1998-5, pp. 511.

Search report from International Application No. PCT/JP2010/051743, mail date is May 11, 2010.

Search report from International Preliminary Report on Patentability for International Application No. PCT/JP2010/051743, mail date is Sep. 22, 2011.

Office Action issued with respect to Chinese Patent Application No. 201080008037.9, mailed Dec. 4, 2012, and English-language translation thereof.

Abstract of WO 91/09922, identified as corresponding to CN 1056894, including indication that U.S. Patent No. 5,403,501 is also a corresponding publication, as obtained from Espacenet.

* cited by examiner

*Primary Examiner* — Prem C Singh
*Assistant Examiner* — Francis C Campanell
(74) *Attorney, Agent, or Firm* — Greenblum & Bernstein, P.L.C.

(57) ABSTRACT

A continuously variable transmission oil composition comprising a base oil and at least one phosphorous compound in such an amount that the phosphorus in the phosphorus compound accounts for 0.005 to 0.15 mass % of the total mass of the composition and wherein the continuously variable transmission oil composition has a friction coefficient from 0.146 to 0.164 when tested according to ASTM D2714.

(1)

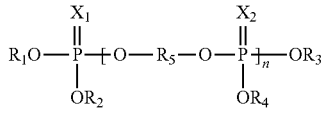

16 Claims, No Drawings

CONTINUOUSLY VARIABLE TRANSMISSION OIL COMPOSITION

TECHNICAL FIELD

The present invention relates to a continuously variable transmission oil composition. In particular, the invention relates to a lubricating oil composition that achieves excellent frictional properties between a metal belt and a pulley or between a metal chain and a pulley in a continuously variable transmission comprising such metal parts.

BACKGROUND ART

Since a metal-belt type or metal-chain type continuously variable transmission allows selective utilization of high combustion efficiency ranges of an engine, it has been attracting attention as a transmission of excellent fuel saving capability. In particular, an increasing number of car models are equipped with a metal-belt continuously variable transmission in recent years. The metal-belt or metal-chain continuously variable transmission is so configured that the torque is transmitted via the friction between the metal belt or chain and the metal pulley, and the speed is changed by varying the pulley radius ratio. Therefore, lubricating oil used for the metal-belt or metal-chain continuously variable transmission is required to provide a high metal-to-metal friction coefficient in order to improve the torque capacity.

A method of adding zinc dialkyldithiophosphate has been proposed for increasing the metal-to-metal friction coefficient (see Non-patent Document 1). However, zinc dialkyldithiophosphate gets worn out through use, causing the problem of decreased metal-to-metal friction coefficient. Moreover, some of the belt-type continuously variable transmissions nowadays are combined with a wet clutch, which is problematic because in such a situation the deterioration products of the zinc dialkyldithiophosphate tend to clog the clutch plate and thus impair its function.

Therefore, a variety of continuously variable transmission fluids that do not contain zinc dialkyldithiophosphate have been proposed, such as a continuously variable transmission oil comprising calcium salicylate, a phosphorus antiwear agent, a friction modifier and a dispersion-type viscosity index improver (Patent Document 1), a continuously variable transmission fluid comprising an ashless polyisobutenyl succinimide dispersant, an organic phosphite, a calcium overbased phenate detergent, a friction modifier containing a succinimide and an ethoxylated amine, and a primary amide of a long-chain carboxylic acid (Patent Document 2), a continuously variable transmission oil comprising a specific mineral lubricating oil base oil, a phosphorous compound and a boron-modified succinimide as ashless dispersant (Patent Document 3), a continuously variable transmission oil comprising a specific phosphorus compound and a boron-modified succinimide as ashless dispersant (Patent Document 4), and a continuously variable transmission oil comprising a boron-containing succinimide ashless dispersant (Patent Document 5).

However, the above transmission oils do not provide a satisfactory friction coefficient for transmitting the high output of high-power engines, and further improvements have thus been desired.

Meanwhile, a use of a lubricant or a functional oil comprising a combination of a specific hydrocarbon-soluble aryl phosphate and a specific hydrocarbon-soluble aryl polyphosphate as antiwear agent has been proposed (Patent Document 6). However, Patent Document 6 does not disclose that the aryl polyphosphate may be used as an additive for the continuously variable transmission oil or that it may increase the metal-to-metal friction coefficient.

PRIOR ART DOCUMENTS

Patent Documents

Patent Document 1: JP-A-2000-355695
Patent Document 2: JP-A-2000-336386
Patent Document 3: JP-A-2000-109875
Patent Document 4: JP-A-2000-109872
Patent Document 5: JP-A-2000-109867
Patent Document 6: Japanese Patent No. 3199844

Non-Patent Document

Non-patent Document 1: Mabuchi et al., "Effect of CVTF additive, ZnDTP, on improvement of transferred torque of belt CVT (First Report)", Japanese Society of Tribologists, proceedings of the Tribology Conference (Tokyo 1998-5), p. 511.

SUMMARY OF THE INVENTION

Problems to be Solved by the Invention

The present invention solves the above-mentioned problems, and thus an object of the invention is to provide a continuously variable transmission oil composition that significantly improves the friction coefficient between a metal belt or chain and a pulley, maintains the high friction coefficient over a long period of time, and does not cause clogging of a clutch plate.

Means for Solving the Problems

The present invention, as a means for solving the above problems, is as follows.

(1) A continuously variable transmission oil composition comprising a lubricating oil base oil, and at least one phosphorus compound shown by the following general formula (1) in such an amount that the phosphorus in the phosphorus compound accounts for 0.005 to 0.15 mass % of the total mass of the composition,

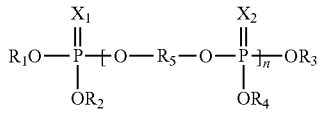

(1)

wherein each of $R_1$, $R_2$, $R_3$ and $R_4$ independently represents a hydrocarbyl group having 1 to 30 carbon atoms, or a hydrogen atom, with at least one of $R_1$, $R_2$, $R_3$ and $R_4$ representing a hydrocarbyl group;

$R_5$ represents a hydrocarbylene group having 1 to 30 carbon atoms;

$X_1$ and $X_2$ each represent an oxygen atom or a sulfur atom; and n is an integer from 1 to 10.

(2) The composition according to (1), further comprising at least one sulfur compound that contains within each molecule one or more chemical bonds selected from S—S bond, S—P bond, S═P bond, S—C bond and S═C bond, and no metal element, in such an amount that the sulfur in the sulfur compound accounts for 0.005 to 0.15 mass % of the total mass of the composition.

(3) The composition according to (1) or (2), wherein the sulfur compound is at least one compound selected from polysulfide compound, thiophosphate ester compound and thiophosphite ester compound.

(4) The composition according to any one of (1) to (3), further comprising a succinimide dispersant in an amount of 0.5 to 10.0 mass % relative to the total mass of the composition.

(5) The composition according to any one of (1) to (4), further comprising an alkaline earth metal detergent in an amount of 0.05 to 1.0 mass % relative to the total mass of the composition.

Effects of the Invention

Since the continuously variable transmission oil composition according to the invention contains the specific phosphorus compound, and preferably further contains the specific sulfur compound, the succinimide dispersant, and/or the alkaline-earth metal detergent, it provides particularly advantageous effects including significantly improved friction coefficient between the metal belt or chain and the pulley, prolonged maintenance of the high friction coefficient, and avoidance of clogging of the clutch plate.

MODES FOR CARRYING OUT THE INVENTION

Lubricating Oil Base Oil

A mineral base oil and/or a synthetic base oil, which is a commonly used lubricating oil base oil, may be used as the lubricating oil base oil in the present invention.

The mineral base oil used in the invention may be, for example, a paraffinic, a naphthenic, or other type of lubricating oil base oil obtained by subjecting a lube oil fraction (which is obtained by distilling crude oil under atmospheric pressure and reduced pressure) to an appropriate combination of purification means such as solvent deasphalting, solvent extraction, hydrocracking, solvent dewaxing, catalytic dewaxing, hydrorefining, sulfuric acid treatment and clay treatment, or may be a lubricating oil base oil obtained by subjecting the wax obtained in solvent dewaxing to isomerization and further dewaxing. Generally, the kinematic viscosity at 100° C. of the mineral base oil is preferably 2 to 7 $mm^2/s$, and more preferably 3 to 5 $mm^2/s$. The viscosity index of the mineral base oil is preferably 80 or higher, while the viscosity index of 100 or higher is especially preferred.

The synthetic base oil suitably used in the invention may be, for example, a poly-α-olefin (such as 1-octene oligomer, 1-decene oligomer, ethylene-propylene oligomer, and the like) or a hydrogenated product thereof, an isobutene oligomer or a hydrogenated product thereof, an isoparaffin, an alkylbenzene, an alkylnaphthalene, a diester, a polyol ester, a polyoxyalkylene glycol, a dialkyl diphenyl ether, a polyphenyl ether, or the like.

A viscosity index improver may be added to the lubricating oil base oil. Specific examples of the viscosity index improver that may be used in the invention include non-dispersion-type viscosity index improvers such as (co)polymer of one or more monomers selected from various methacrylate esters and hydrogenated products thereof, dispersion-type viscosity index improvers such as (co)polymers of various methacrylate esters of nitrogen compounds, non-dispersion-type or dispersion-type ethylene-α-olefin copolymers and hydrogenated products thereof, polyisobutylene and hydrogenated products thereof, hydrogenated styrene-diene copolymers, styrene-maleic anhydride copolymer, polyalkylstyrene, and the like, all of which are viscosity index improvers commonly used in lubricating oils.

One or more viscosity index improvers selected from the above may be added in appropriate amounts to impart the desired effect. The viscosity index improver is preferably added in an amount of 1 to 20 mass % relative to the total mass of the composition. It is preferable that the lubricating oil base oil including the viscosity index improver has a kinematic viscosity at 100° C. of 4 to 10 $mm^2/s$, more preferably 5 to 9 $mm^2/s$, and has a viscosity index of 120 or higher, more preferably 140 or higher.

Generally, it is preferable that the lubricating oil base oil is used in an amount of 98 mass % at most, more preferably in an amount of 98 to 62 mass %, relative to the total mass of the composition (i.e. the continuously variable transmission oil composition). The kinematic viscosity of the lubricating oil base oil may be appropriately selected within the above ranges depending on the type of the continuously variable transmission.

Phosphorus Compound

The continuously variable transmission oil composition according to the invention comprises at least one phosphorus compound shown by the following general formula (1).

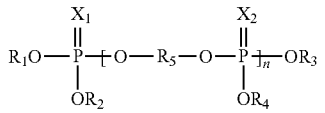

(1)

In the general formula (1), each of the functional groups $R_1$, $R_2$, $R_3$ and $R_4$ independently represents a hydrocarbyl group or a hydrogen atom. However, $R_1$, $R_2$, $R_3$ and $R_4$ cannot all represent hydrogen atoms, i.e. at least one of them is a hydrocarbyl group. Examples of the hydrocarbyl group include alkyl groups, cycloalkyl groups, aryl groups, alkylaryl groups and the like. The number of carbon atoms of the hydrocarbyl group is 1 to 30, preferably 1 to 20, and more preferably 3 to 9. $R_1$, $R_2$, $R_3$ and $R_4$ may have identical or different structures from one another. $R_5$ represents a hydrocarbylene group. Examples of the hydrocarbylene group include alkylene groups, cycloalkylene groups, arylene groups, alkylarylene groups and the like. The number of carbon atoms of the hydrocarbylene group is 1 to 30, preferably 1 to 20, and more preferably 3 to 9. $X_1$ and $X_2$ each represent an oxygen atom or a sulfur atom. n is an integer from 1 to 10, preferably from 1 to 5, and more preferably from 1 to 3. In the case where n is plural, $R_4$ (or $R_5$ or $X_2$) in one unit may have an identical or different structure from $R_4$ (or $R_5$ or $X_2$, respectively) in another unit. An especially preferable compound of the formula (1) is tetraphenyl (m-phenylene) bisphosphate in which $X_1$ and $X_2$ each represent an oxygen atom, $R_1$, $R_2$, $R_3$ and $R_4$ each represent a phenyl group, $R_5$ represents a phenylene group, and n is 1.

The phosphorus compounds shown by the general formula (1) have been disclosed in Japanese Patent No. 3199844, and can be synthesized according to the disclosures therein. The phosphorus compounds are also widely known as flame retardants for synthetic resins (see JP-A-2003-192919, for example), some of which are commercially available. The phosphorus compound used in the present invention may be suitably chosen from these commercially available ones.

The continuously variable transmission oil composition according to the invention should contain at least one phosphorus compound shown by the general formula (1), and it may further contain other phosphorus compounds, such as a phosphate ester, a phosphite ester, an alkyl acid phosphate or an alkyl acid phosphite each containing one phosphorus atom in the molecule, amine salts thereof, a thiophosphate ester that further contains a sulfur atom in the molecule, and the like, all of which are used as antiwear additives in common lubricating oils.

The phosphorus compound shown by the general formula (1) is added in the composition in such an amount that the mass of the phosphorus element in the phosphorus compound accounts for 0.005 to 0.15 mass %, preferably 0.005 to 0.10 mass %, of the total mass of the composition. The total phosphorus content in the composition is preferably 0.01 to 0.15 mass % relative to the total mass of the composition, more preferably 0.01 to 0.10 mass %. If the amount of the phosphorus is less than 0.005 mass %, the metal-to-metal friction coefficient may not be sufficiently improved and sufficient antiwear performance may not be obtained. If the amount of the phosphorus exceeds 0.15 mass %, the material compatibility may be compromised.

Sulfur Compound

The continuously variable transmission oil composition according to the invention preferably contains at least one sulfur compound. The sulfur compound has at least one S—S bond, S—P bond, S═P bond, S—C bond or S═C bond within an individual molecule (i.e. intra-molecularly), and is devoid of a metal element. Specific examples of the sulfur compound include dibenzyl disulfide which is a polysulfide compound ($R—S_n—R$) having an S—S bond and S—C bonds in one molecule, and trilauryl trithiophosphate which is a thiophosphate ester compound ($(R—X)_3—P═X$, wherein X represents an oxygen atom or a sulfur atom and at least one of the four Xs represents a sulfur atom) having S—P bonds in one molecule. Further examples of the sulfur compound include sulfide compounds (R—S—R), sulfoxide compounds (R—S(═O)—R), sulfone compounds ($R—S(═O)_2—R$), polysulfone compounds ($R—[S(═O)_2]_n—R$), thiazole compounds, thiadiazole compounds, thiol compounds (R—SH), thioketone compounds (R—C(═S)—R), thiophosphite compounds ($(R—X)_3—P$, wherein X represents an oxygen atom or a sulfur atom and at least one of the three Xs represents a sulfur atom), and the like. Among these sulfur compounds, polysulfide compounds, thiophosphate compounds and the thiophosphite compounds are particularly preferable. R in the sulfur compounds above represents a hydrocarbon group, which may be an alkyl group, aryl group, alkylaryl group, or the like. The number of carbon atoms of the hydrocarbon group is preferably 1 to 30, and more preferably 1 to 20.

The sulfur compound may be selected from commercially available products that are added to various lubricating oils such as gear oil, metalworking fluid, hydraulic oil, automatic transmission fluid and the like, as an extreme pressure agent or for other purposes. These sulfur compounds may be used either individually or in combination.

The sulfur compound is preferably added to the composition in such an amount that the sulfur in the sulfur compound accounts for 0.001 to 0.15 mass % of the total mass of the composition, and more preferably 0.005 to 0.10 mass %. If the amount of the sulfur is less than 0.001 mass %, the metal-to-metal friction coefficient may not be sufficiently improved. On the other hand, if the amount of the sulfur exceeds 0.15 mass %, the oxidation stability and the wear resistance capability of the composition may be compromised. The total sulfur content of the composition is preferably 0.005 to 0.20 mass %, more preferably 0.01 to 0.15 mass %.

Succinimide Dispersant

The succinimide dispersant which can preferably be used in the continuously variable transmission oil composition according to the invention contains a succinimide compound as a main component. Examples of the succinimide compound include so-called mono-type succinimides shown by the following general formula (2) in which a succinic anhydride is added to one end of a polyamine during imidation, and so-called bis-type succinimides shown by the following general formula (3) in which a succinic anhydride is added to each of the two ends of a polyamine, as well as variations of these succinimides that contain boron.

(2)

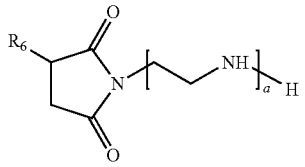

(3)

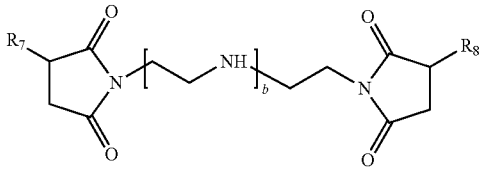

In the formulas (2) and (3) above, $R_6$, $R_7$ and $R_8$ independently represent an alkyl group or an alkenyl group, a is an integer from 1 to 10, preferably from 2 to 5, and b is an integer from 1 to 10, preferably from 2 to 5.

In the present invention any dispersant selected from these succinimide compounds may be used. The dispersant may be selected from the commercially available products that are used as ashless dispersant in various lubricating oils, such as gear oil, metalworking oil, hydraulic oil, automatic transmission oil and the like. These dispersants may be used either individually or in combination.

The succinimide dispersant is preferably used in an amount of 0.5 to 10.0 mass % relative to the total mass of the composition, and more preferably 2.0 to 8.0 mass %.

Alkaline-Earth Metal Detergent

An alkaline-earth metal detergent which may be preferably used in the continuously variable transmission oil composition according to the invention can reduce the sliding speed dependency of the friction coefficient between the belt or chain and the pulley of a continuously variable transmission when the lubricating oil has started deteriorating, and can improve the metal-to-metal frictional properties. The alkaline-earth metal detergent used in the invention may comprise a sulfonate, phenate or salicylate that contains an alkaline-earth metal, such as magnesium, calcium and barium. So-called overbased metal detergent having a high base number (BN) may also be used. In the present invention, one or more alkaline-earth metal detergents selected from these compounds, or other compounds used as metal detergent in common lubricating oils, may be used.

The metal detergent is preferably added in an amount of 0.05 to 1.0 mass % relative to the total mass of the composition, and more preferably 0.1 to 0.5 mass %. This makes it possible to increase the friction coefficient and to significantly improve the performance of the continuously variable transmission. If the metal detergent content is within the above ranges, a high metal-to-metal friction coefficient can be maintained even after the lubricating oil composition has been used for a long period of time, and moreover, the oxidation stability of the lubricating oil is also maintained.

Zinc Dialkyldithiophosphate

The continuously variable transmission oil composition according to the invention does not substantially contain a zinc dialkyldithiophosphate. The expression "does not substantially contain" herein means that the continuously variable transmission oil composition does not contain a zinc dialkyldithiophosphate at all, or even if does, the amount of the zinc dialkyldithiophosphate is less than the amount that would damage the function of the clutch plate due to clogging when the lubricating oil has started deteriorating, or more specifically, the amount of the zinc dialkyldithiophosphate is such that the zinc element in the said compound accounts for no more than 0.001 mass % of the total mass of the composition. It is more preferable that the continuously variable transmission oil composition does not contain a zinc dialkyldithiophosphate at all.

Other Additives

The continuously variable transmission oil composition according to the invention may further comprise other additives not mentioned above, such as antioxidant, pour-point depressant, friction modifier, and the like.

A phenol compound, an amine compound or the like that is commonly used as antioxidant for lubricating oil may be used in the present invention suitably. Specific examples of suitable antioxidants include alkylphenols such as 2,6-di-tert-butyl-4-methylphenol, bisphenols such as methylene-4,4-bisphenol(2,6-di-tert-butyl-4-methylphenol), naphthylamines such as phenyl-α-naphthylamine, dialkyldiphenylamines, esters of a (3,5-di-tert-butyl-4-hydroxyphenyl) fatty acid (e.g. propionic acid, etc.) and monohydric or polyhydric alcohols (e.g. methanol, octadecanol, 1,6-hexanediol, neopentyl glycol, thiodiethylene glycol, triethylene glycol, pentaerythritol, etc.), and the like. One or more compounds appropriately selected from these antioxidants may be added to the composition, and the added amount is preferably 0.1 to 2 mass % relative to the total mass of the composition.

Any compound commonly used as friction modifier for lubricating oil may be used as the friction modifier in the present invention. Specific examples of the friction modifier include amine compounds, fatty acid amides, fatty acid metal salts, and the like having at least one alkyl group or alkenyl group having 6 to 30 carbon atoms (particularly at least one linear alkyl group or linear alkenyl group having 6 to 30 carbon atoms) in the molecule. One or more compounds appropriately selected from these friction modifiers may be added to the composition in a desired amount, but it is generally preferable that the amount is within the range of 0.1 to 2 mass % relative to the total mass of the composition.

EXAMPLES

The invention is further described in detail below by way of examples and comparative examples. However, the invention is not limited to the following examples.

Preparation of Continuously Variable Transmission Oil Composition

Continuously variable transmission oil compositions of Examples 1 to 19 and Comparative Examples 1 to 14 were prepared respectively by mixing the following lubricating oil base oil and additives in the mixing ratios shown in the upper portion of Tables 1 to 3 (the added amounts are expressed as mass % in relation to the total mass of the composition).

Lubricating Oil Base Oil

O-1: Hydrorefined base oil (kinematic viscosity at 100° C.: 4.3 $mm^2/s$, viscosity index: 124)

O-2: Diisodecyl adipate (kinematic viscosity at 100° C.: 3.6 $mm^2/s$, viscosity index: 146)

Additive (1) Phosphorus Compound Shown by the Above-Mentioned General Formula (1)

P-1: Tetraphenyl (m-phenylene) bisphosphate (in formula (1), $X_1=X_2=O$, $R_1=R_2=R_3=R_4$=phenyl group, $R_5$=phenylene group, and n=1; phosphorus content in the compound itself: 10.9 mass %)

(2) Phosphorus Compound Other than (1) Above

P-2: Tricresyl phosphate

P-3: 2-Ethylhexyl acid phosphate oleylamine salt (3) Sulfur Compound

S-1: Dibenzyl disulfide

S-2: Trilauryl trithiophosphate

S-3: Triphenyl phosphorothionate

S-4: Ethyl-3-[[bis(1-methylethoxy)phosphinothioyl]thio] propionate (3) Succinimide Dispersant I-1: Non-boron-containing succinimide (mono-type)

I-2: Non-boron-containing succinimide (bis-type)

I-3: Boron-containing succinimide (bis-type; boron content (the amount of boron element): 0.5 mass %)

(4) Alkaline-Earth Metal Detergent

C-1: Overbased calcium sulfonate (TBN: 300)

C-2: Neutral calcium sulfonate (TBN: 20)

(5) Other Additives

In all Examples and Comparative Examples, a same package of additives, consisting of those selected from antioxidants, corrosion inhibitors, pour-point depressants, viscosity index improvers and friction modifiers, was added in a same amount (4.9 mass % relative to the total mass of the composition).

Evaluation

The friction coefficient and the wear track width of the test block obtained with the continuously variable transmission oil compositions of Examples and Comparative Examples were measured under the following test conditions by using a block-on-ring tester (LFW-1) in accordance with ASTM D2714. The friction coefficient was measured after 60 minutes from the start of the test (i.e. immediately before the end of the test), and the wear track width of the block was measured after the end of the test.

Test Conditions

Ring: Falex S-10 Test Ring (SAE4620 steel)

Block: Falex H-60 Test Block (SAE01 steel)

Temperature: 80° C.

Load: 445 N

Sliding speed: 0.33 m/s

Test time: 60 min

The measurement results are shown in Tables 1 to 3. The larger friction coefficient in the test means higher transfer efficiency of the continuously variable transmission, and hence the superiority of the corresponding continuously variable transmission oil.

TABLE 1

| | | | Example | | | | | | | | | | |
|---|---|---|---|---|---|---|---|---|---|---|---|---|---|
| | | | 1 | 2 | 3 | 4 | 5 | 6 | 7 | 8 | 9 | 10 | 11 |
| Base oil | O-1 | mass % | 88.4 | 88.6 | 88.4 | 88.8 | 88.4 | 84.0 | 84.2 | 79.6 | 79.7 | 75.1 | 70.7 |
| | O-2 | mass % | | | | | | 4.4 | 4.4 | 8.8 | 8.9 | 13.3 | 17.7 |
| Phosphorus | P-1 | mass % | 0.5 | 0.3 | 0.3 | 0.1 | 0.1 | 0.5 | 0.3 | 0.5 | 0.3 | 0.5 | 0.5 |
| compound | P-2 | mass % | | | 0.2 | | 0.4 | | | | | | |
| Dispersant | I-1 | mass % | 6.0 | 6.0 | 6.0 | 6.0 | 6.0 | 6.0 | 6.0 | 6.0 | 6.0 | 6.0 | 6.0 |
| Detergent | C-1 | mass % | 0.2 | 0.2 | 0.2 | 0.2 | 0.2 | 0.2 | 0.2 | 0.2 | 0.2 | 0.2 | 0.2 |
| Other additives | | mass % | 4.9 | 4.9 | 4.9 | 4.9 | 4.9 | 4.9 | 4.9 | 4.9 | 4.9 | 4.9 | 4.9 |
| Phosphorus content originating from the phosphorus compound of formula (1) | | mass % | 0.054 | 0.032 | 0.032 | 0.011 | 0.011 | 0.054 | 0.032 | 0.054 | 0.032 | 0.054 | 0.054 |
| Total phosphorus content in the composition | | mass % | 0.054 | 0.032 | 0.045 | 0.011 | 0.045 | 0.054 | 0.032 | 0.054 | 0.032 | 0.054 | 0.054 |
| LFW-1 (Friction coefficient μ60) | | | 0.158 | 0.152 | 0.156 | 0.139 | 0.141 | 0.158 | 0.156 | 0.160 | 0.146 | 0.154 | 0.153 |
| LFW-1 (Wear track width) | | mm | 0.608 | 0.550 | 0.604 | 0.517 | 0.454 | 0.562 | 0.550 | 0.550 | 0.540 | 0.555 | 0.566 |

TABLE 2

| | | | Example | | | | | | | | Comparative Example | | |
|---|---|---|---|---|---|---|---|---|---|---|---|---|---|
| | | | 12 | 13 | 14 | 15 | 16 | 17 | 18 | 19 | 1 | 2 | 3 |
| Base oil | O-1 | mass % | 91.1 | 91.1 | 91.0 | 91.0 | 91.0 | 90.6 | 91.0 | 91.0 | 91.1 | 91.0 | 91.0 |
| Phosphorus | P-1 | mass % | 0.5 | 0.3 | 0.5 | 0.3 | 0.3 | 0.3 | 0.3 | 0.3 | | | |
| compound | P-2 | mass % | | 0.2 | | 0.2 | 0.2 | 0.2 | 0.2 | 0.2 | 0.5 | 0.5 | 0.5 |
| Sulfur | S-1 | mass % | | | 0.1 | 0.1 | | | | | | 0.1 | |
| compound | S-2 | mass % | | | | | 0.1 | 0.5 | | | | | 0.1 |
| | S-3 | mass % | | | | | | | 0.1 | | | | |
| | S-4 | mass % | | | | | | | | 0.1 | | | |
| Dispersant | I-1 | mass % | 3.0 | 3.0 | 3.0 | 3.0 | 3.0 | 3.0 | 3.0 | 3.0 | 3.0 | 3.0 | 3.0 |
| Detergent | C-1 | mass % | 0.5 | 0.5 | 0.5 | 0.5 | 0.5 | 0.5 | 0.5 | 0.5 | 0.5 | 0.5 | 0.5 |
| Other additives | | mass % | 4.9 | 4.9 | 4.9 | 4.9 | 4.9 | 4.9 | 4.9 | 4.9 | 4.9 | 4.9 | 4.9 |
| Phosphorus content originating from the phosphorus compound of formula (1) | | mass % | 0.054 | 0.032 | 0.054 | 0.032 | 0.032 | 0.032 | 0.032 | 0.032 | | | |
| Total phosphorus content in the composition | | mass % | 0.054 | 0.054 | 0.054 | 0.045 | 0.050 | 0.069 | 0.054 | 0.055 | 0.042 | 0.042 | 0.047 |
| Sulfur content originating from the sulfur compound | | mass % | | | 0.026 | 0.026 | 0.015 | 0.076 | 0.009 | 0.020 | | 0.026 | 0.015 |
| Total sulfur content in the composition | | mass % | 0.005 | 0.005 | 0.031 | 0.031 | 0.020 | 0.081 | 0.014 | 0.025 | 0.005 | 0.031 | 0.020 |
| LFW-1 (Friction coefficient μ60) | | | 0.152 | 0.152 | 0.164 | 0.164 | 0.166 | 0.161 | 0.164 | 0.162 | 0.133 | 0.135 | 0.138 |
| LFW-1 (Wear track width) | | mm | 0.548 | 0.608 | 0.602 | 0.623 | 0.641 | 0.621 | 0.656 | 0.581 | 0.603 | 0.547 | 0.550 |

TABLE 3

| | | | Comparative Example | | | | | | | | | | |
|---|---|---|---|---|---|---|---|---|---|---|---|---|---|
| | | | 4 | 5 | 6 | 7 | 8 | 9 | 10 | 11 | 12 | 13 | 14 |
| Base oil | O-1 | mass % | 88.4 | 88.4 | 88.9 | 91.6 | 91.4 | 91.4 | 91.6 | 91.4 | 91.4 | 91.4 | 88.4 |
| Phosphorus | P-2 | mass % | 0.5 | | | 0.5 | 0.5 | 0.5 | 0.5 | 0.5 | 0.5 | 0.5 | 0.5 |
| compound | P-3 | mass % | | 0.5 | | | | | | | | | |
| Dispersant | I-1 | mass % | 6.0 | 6.0 | 6.0 | 3.0 | 3.0 | 3.0 | | | | | |
| | I-2 | mass % | | | | | | | 3.0 | 3.0 | 3.0 | | 3.0 |
| | I-3 | mass % | | | | | | | | | | 3.0 | 3.0 |
| Detergent | C-1 | mass % | 0.2 | 0.2 | 0.2 | | 0.2 | | | 0.2 | | 0.2 | 0.2 |
| | C-2 | mass % | | | | | | 0.2 | | | 0.2 | | |
| Other additives | | mass % | 4.9 | 4.9 | 4.9 | 4.9 | 4.9 | 4.9 | 4.9 | 4.9 | 4.9 | 4.9 | 4.9 |
| Total phosphorus content in the composition | | mass % | 0.042 | 0.029 | 0.000 | 0.042 | 0.042 | 0.042 | 0.042 | 0.042 | 0.042 | 0.042 | 0.042 |
| Total sulfur content in the composition | | mass % | 0.005 | 0.005 | 0.005 | 0.005 | 0.005 | 0.005 | 0.005 | 0.005 | 0.005 | 0.005 | 0.005 |
| LFW-1 (Friction coefficient μ60) | | | 0.133 | 0.117 | 0.119 | 0.126 | 0.133 | 0.130 | 0.124 | 0.127 | 0.127 | 0.129 | 0.132 |
| LFW-1 (Wear track width) | | mm | 0.581 | 0.627 | 0.520 | 0.568 | 0.490 | 0.536 | 0.531 | 0.547 | 0.511 | 0.524 | 0.499 |

As is clear from these results, the compositions of Comparative Examples 1 to 14 that did not contain the phosphorus compound of the general formula (1) had a friction coefficient (μ60), which was measured after 60 minutes from the start of the test, of 0.117 to 0.138. On the other hand, the continuously variable transmission oil compositions of Examples 1 to 19 that contained the phosphorus compound shown by the general formula (1) had a friction coefficient (μ60) of 0.139 to 0.164, which was clearly higher than that of Comparative Examples. As shown in Examples 3, 5, 13, and 15 to 19, it was found that the phosphorus compound expressed by the general formula (1) was capable of increasing the friction coefficient even when it was combined with another phosphorus compound not expressed by the general formula (1). Meanwhile, the extent of wear was not changed by addition of the phosphorus compound, indicating that the compositions consistently provided satisfactory wear resistance. Moreover, the continuously variable transmission oil compositions of Examples 1 to 19 did not contain any of those additives that would tend to cause clogging of a clutch plate upon deterioration of the lubricating oil, such as zinc dialkyldithiophosphate, and therefore such problems as clogging of a clutch plate may be avoided even when the composition is used for a long period of time.

With the compositions of Examples 14 to 19 which comprised the sulfur compound in addition to the phosphorus compound of the general formula (1), the friction coefficient at 60 minutes (μ60) exceeded 0.16, which was remarkably high.

INDUSTRIAL APPLICABILITY

Since the continuously variable transmission oil composition according to the present invention exhibits a high friction coefficient and does not contain those additives which would cause clogging of a clutch plate, it is expected that the continuously variable transmission oil composition may be effectively used as lubricating oil composition for metal-belt or metal-chain continuously variable transmissions which are attracting attention for the excellent energy efficiency they could provide in automobiles, to enable trouble-free and energy-efficient performance for a long period of time.

The invention claimed is:

1. A continuously variable transmission oil composition comprising:

1.) a lubricating oil base oil, and

2.) at least one phosphorus compound shown by the following formula (1) in such an amount that the phosphorus in the phosphorus compound accounts for 0.005 to 0.15 mass % of the total mass of the composition,

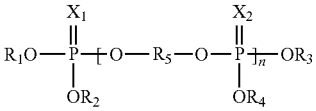

(1)

wherein each of $R_1$, $R_2$, $R_3$ and $R_4$ independently represents an aryl group or an alkylaryl group having 1 to 30 carbon atoms, or a hydrogen atom, with at least one of $R_1$, $R_2$, $R_3$ and $R_4$ representing an aryl group or an alkylaryl group, $R_5$ represents an arylene group or an alkylarylene group having 1 to 30 carbon atoms, $X_1$ and $X_2$ each represent an oxygen atom or a sulfur atom, and n is an integer from 1 to 10, and wherein the continuously variable transmission oil composition has a friction coefficient from 0.146 to 0.164 when tested according to ASTM D2714.

2. The composition according to claim 1, further comprising at least one compound selected from a polysulfide compound, a thiophosphate ester compound, and a thiophosphite ester compound.

3. The composition according to claim 1, further comprising a succinimide dispersant in an amount of 0.5 to 10.0 mass % relative to the total mass of the composition.

4. The composition according to claim 1, further comprising an alkaline-earth metal detergent in an amount of 0.05 to 1.0 mass % relative to the total mass of the composition.

5. The composition according to claim 2, further comprising a succinimide dispersant in an amount of 0.5 to 10.0 mass % relative to the total mass of the composition.

6. The composition according to claim 2, further comprising an alkaline-earth metal detergent in an amount of 0.05 to 1.0 mass % relative to the total mass of the composition.

7. The composition according to claim 3, further comprising an alkaline-earth metal detergent in an amount of 0.05 to 1.0 mass % relative to the total mass of the composition.

8. The composition according to claim 5, further comprising an alkaline-earth metal detergent in an amount of 0.05 to 1.0 mass % relative to the total mass of the composition.

9. A method for lubricating a continuously variable transmission comprising:

lubricating a continuously variable transmission with a continuously variable transmission oil composition comprising:

1.) a lubricating base oil; and

2.) at least one phosphorous compound represented by the following formula (1) in such an amount that the phosphorous in the phosphorous compound accounts for 0.005 to 0.15 mass % of the total mass of the composition,

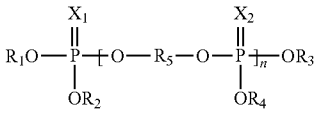

(1)

wherein each of $R_1$, $R_2$, $R_3$, and $R_4$ independently represents an aryl group or an alkylaryl group having 1 to 30 carbon atoms or a hydrogen atom, with at least one of $R_1$, $R_2$, $R_3$, and $R_4$ representing an aryl group or an alkylaryl group, $R_5$ represents an arylene group or an alkylarylene group having 1 to 30 carbon atoms, $X_1$ and $X_2$ each represent an oxygen atom or a sulfur atom, and n is an integer from 1 to 10, and wherein the continuously variable transmission oil composition has a friction coefficient from 0.146 to 0.164 when tested according to ASTM D2714.

10. The method for lubricating a continuously variable transmission according to claim 9, wherein the continuously variable transmission oil composition further comprises at least one compound selected from a polysulfide compound, a thiophosphate ester compound, and a thiophosphite ester compound.

11. The method for lubricating a continuously variable transmission according to claim 9, wherein the continuously variable transmission oil composition further comprises a succinimide dispersant in an amount of 0.5 to 10.0 mass % relative to the total mass of the composition.

12. The method for lubricating a continuously variable transmission according to claim 9, wherein the continuously variable transmission oil composition further comprises an alkaline-earth metal detergent in an amount of 0.05 to 1.0 mass % relative to the total mass of the composition.

13. The method for lubricating a continuously variable transmission according to claim 10, wherein the continuously variable transmission oil composition further comprises a succinimide dispersant in an amount of 0.5 to 10.0 mass % relative to the total mass of the composition.

14. The method for lubricating a continuously variable transmission according to claim 10, wherein the continuously variable transmission oil composition further comprises an alkaline-earth metal detergent in an amount of 0.05 to 1.0 mass % relative to the total mass of the composition.

15. The method for lubricating a continuously variable transmission according to claim 11, wherein the continuously variable transmission oil composition further comprises an alkaline-earth metal detergent in an amount of 0.05 to 1.0 mass % relative to the total mass of the composition.

16. The method for lubricating a continuously variable transmission according to claim 13, wherein the continuously variable transmission oil composition further comprises an alkaline-earth metal detergent in an amount of 0.05 to 1.0 mass % relative to the total mass of the composition.

* * * * *